United States Patent [19]

Iwasaki

[11] 4,446,842

[45] May 8, 1984

[54] IGNITION SYSTEM

[75] Inventor: Shinichiro Iwasaki, Troy, Mich.

[73] Assignee: Aisin Seiki Kabushiki Kaisha, Aichi, Japan

[21] Appl. No.: 383,607

[22] Filed: Jun. 1, 1982

Related U.S. Application Data

[63] Continuation-in-part of Ser. No. 268,889, Jun. 1, 1981, Pat. No. 4,382,430.

[51] Int. Cl.[3] ..... F02P 3/04

[52] U.S. Cl. ..... 123/606; 123/169 PA; 123/621; 123/634; 123/635; 123/643

[58] Field of Search ..... 123/606, 607, 608, 621, 123/622, 634, 636, 635, 637, 643, 644, 169 PA, 169 PB, 169 PH

[56] References Cited

U.S. PATENT DOCUMENTS

| | | | |
|---|---|---|---|
| 1,501,484 | 7/1924 | Hunt | 123/621 |
| 1,501,485 | 7/1924 | Hunt | 123/621 |
| 2,940,013 | 6/1960 | Cook | 123/606 X |
| 3,716,038 | 2/1973 | Bevacqua . | |
| 4,233,949 | 11/1980 | d'Orsay . | |
| 4,349,008 | 9/1982 | Wainwright | 123/606 X |

FOREIGN PATENT DOCUMENTS

| | | | |
|---|---|---|---|
| 70572 | 1/1983 | European Pat. Off. | 123/637 |

*Primary Examiner*—Tony M. Argenbright

*Attorney, Agent, or Firm*—Oblon, Fisher, Spivak, McClelland & Maier

[57] ABSTRACT

An ignition system for an internal combustion engine, wherein separate ignition transformers are mounted directly on respective spark plugs and an A.C. drive signal is applied to the ignition transformers sequentially in accordance with engine timing to fire the spark plugs sequentially. The A.C. drive signal is applied to each of the ignition transformers by means of a leakage transformer whereby ignition currents are maintained at a relatively low level after initiation of the ignition discharge across the spark plug electrodes. In one embodiment, each ignition transformer is composed of plural individual transformers disposed in a planetary arrangement around an axis defined by the respective spark plug. Each of these individual transformers includes at least one secondary winding and at least one primary winding wound on a respective core, with each of the secondary windings mounted in series across the electrodes of the spark plug.

18 Claims, 22 Drawing Figures

IGNITION SYSTEM

CROSS-REFERENCE TO RELATED APPLICATIONS

This application is a continuation-in-part of pending U.S. application Ser. No. 268,889 filed June 1, 1981, and now Pat. No. 4,382,430.

BACKGROUND OF THE INVENTION

1. Field of the Invention:

The present invention relates in general to a novel ignition system, and especially such a system for use with internal combustion engines.

2. Description of the Prior Art

Conventional ignition systems for internal combustion engines have proven themselves to be reliable and adequate for many years. In recent times these systems have been upgraded by means of various electronic switching apparata. However, even with the addition of electronic apparata, the systems remain very similar in operation to the conventional electromechanical systems.

FIG. 1 is a circuit diagram illustrating a conventional ignition circuit employing an ignition transformer T having a primary winding coil PC and a secondary winding coil SC wound around a common core C. A current is introduced to the primary winding coil PC from the battery Vcc through a switch SW, such as a transistor. The energy of the ignition current supplied via switch SW is accumulated as magnetic energy and discharged through the secondary (high voltage) winding coil SC across the electrodes of spark plug SP.

Modern engines are required to meet a multitude of ever tightening standards regarding the quantity and quality of exhaust emissions. In order to meet these requirements, engine manufacturers have resorted to producing engines which operate under very lean fuel to air mixtures and engines which employ stratified charge or turbulant flow technology. Lean burning engines require increased spark duration for proper operation. Ihis is accomplished in the conventional systems by increasing the open circuit spark voltage. However, increasing the voltage results in an increase in the amplitude as well as the duration of the spark current which greatly decreases the life of the spark plugs. In turbulant flow-type systems, the flow of the charge within the individual cylinders of the engine tends to blow out or extinguish the arc occuring within the spark plug prematurely thereby decreasing the duration of the spark which is detrimental to proper ignition.

Another problem inherent in conventional designs is that they generally use a common high voltage generator in the form of a single ignition coil for all the spark plugs in the engine. The high voltage from the single coil is then distributed to the various plugs by means of a rotary high voltage switch or distributer and a system of high voltage cables. The distribution and high voltage cables are well known to be frequent sources of problems and thus are the weak links in the conventional system.

SUMMARY OF THE INVENTION

Accordingly, one object of this invention is to provide a novel AC ignition system wherein the duration of ignition can be increased over that of a conventional system without decreasing the life of the spark plugs.

Another object of the present invention is to provide a novel AC ignition system which eliminates the need for a high voltage distribution system.

Still another object is to provide a novel ignition system wherein a separate high voltage generator is provided for each spark plug in the engine.

Yet another objective is to provide a novel ignition transformer and spark plug cover assembly wherein the ignition transformer surrounds the spark plug and is enclosed in a cover which includes connectors for the spark plug.

Another object of this invention is to provide an ignition system employing a novel transformer and spark plug cover assembly of the above-noted type whereby it is possible to reduce the size of the ignition coil and yet maintain adequate energy discharge across the spark plug electrodes.

Yet another object is to provide a novel AC ignition system which produces an alternating current and therefore an intermittent spark within the spark plug. In such an AC system, the duration of the ignition can be greatly increased over that of the conventional systems without a corresponding decrease in spark plug life. Also, since the total ignition comprises a plurality of short intermittent sparks, the blow out problems of turbulant flow engines are greatly reduced.

Still a further object of this invention is to provide a novel ignition system which overcomes the difficulties inherent in the conventional systems utilizing a common high voltage generator by providing an essentially independent high voltage generator system for each spark plug in the engine. An individual ignition transformer is provided for each spark plug. In a preferred embodiment, each ignition transformer is built into a novel spark plug cover which thus acts to eliminate the need for high voltage wiring. The distributer of the conventional system is also electronically eliminated.

These and other objects are acheived in accordance with the invention by providing a new and improved ignition system for an internal combustion engine, wherein separate ignition transformers are mounted directly on respective spark plugs and an AC drive signal is applied to the ignition transformers sequentially in accordance with engine timing to fire the spark plugs sequentially. The AC drive signal is applied to each of the ignition transformers by means of a leakage transformer whereby ignition currents are maintained at relatively low levels after initiation of the ignition discharge across the spark plug electrodes. In one embodiment, each ignition transformer is composed of plural individual transformers disposed in a planetary arrangement around an axis defined by the respective spark plug. Each of these individual transformers includes at least one secondary winding and at least one primary winding wound on a respective core, with each of the secondary windings mounted in series across the electrodes of the spark plug.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
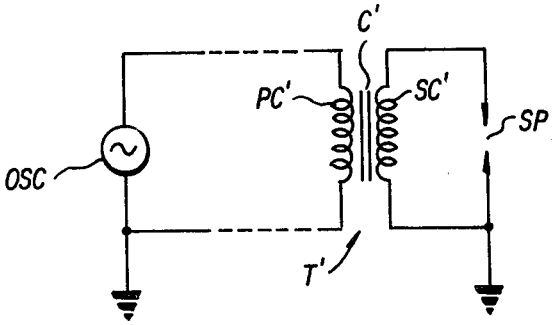
FIG. 2 is a simplified circuit diagram of a high frequency, high voltage ignition circuit according to the invention.

Referring now to the drawings, wherein like reference numerals designate identical or corresponding parts throughout the several views, and more particularly to FIG. 2 thereof, there is shown in schematic form an ignition system according to the present invention employing an AC source, OSC, driving a high voltage/high frequency ignition transformer T′, having a primary coil PC′ and a secondary coil SC′ would on an ignition core C′.

Referring to FIGS. 3, 4, 5A, 5B, 6, 7 and 8, a first embodiment of the invention as disclosed in copending parent application Ser. No. 268,889 is illustrated.

Figure 4:
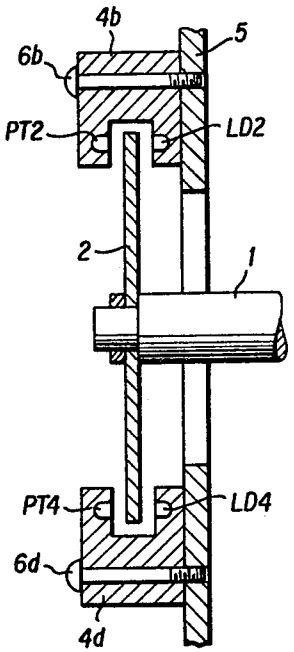
FIG. 4 is a cross-sectional side view of the rotational position sensor shown in FIG. 3.
Figure 3:
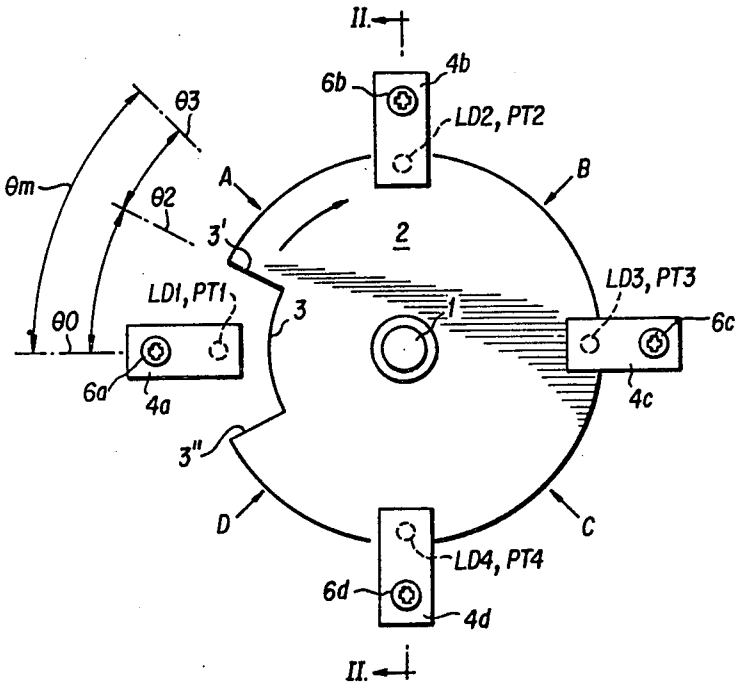
FIG. 3 is a plan view of a rotational position sensor used to establish ignition timing for the ignition system of the invention.

FIG. 3 illustrates a plan view and FIG. 4 illustrates a sectional view taken along line II—II in FIG. 3 of a crankshaft position sensor which includes a shaft 1 coupled to rotate in synchronism with the crankshaft of a four cylinder engine (not illustrated). Coupled to and rotating therewith is a circular shutter 2 having a segmented opening 3 in its circumferential edge. The shutter 2 is shown as rotating clockwise in the direction of the arrow shown in FIG. 3.

Positioned about the shutter 2 are four photo-interrupters 4*a* through 4*d* which are attached to a stationary member 5 of the engine by means of fasteners 6*a* through 6*d*, respectively. As best seen in FIG. 4, the shutter 3 passes through an open portion of each photo-interrupter. Located at one side of each opening in the photo-interrupters 4*a* through 4*d* are light emitting diodes LD1 through LD4, respectively, which act as constant light sources. Positioned on the opposite side of each opening are photo-transistors PT1 through PT4, respectively. The shutter 2 is positioned to pass between each pair of light emitting diodes and photo-transistors such that the passage of the segmented opening through each photo-interrupter 4*a* through 4*d* may be detected. Thus in FIG. 3, when the leading edge 3′ of the opening 3 of the shutter 2 passes through the center of the photo-interrupter 4*a*, the phototransmitter PT1 receives light from the light emitting diode LD1 and becomes turned on. The photo-transistor PT1 remains on until the trailing edge 3″ of the opening 3 passes through the center of the photo-interrupter. A similar action takes place within the other photo-interrupters 4*b* through 4*d*. The outputs of the photo-interrupter 4*a* through 4*d* are utilized to provide firing signals for the ignition system of the present invention.

Figure 5A:
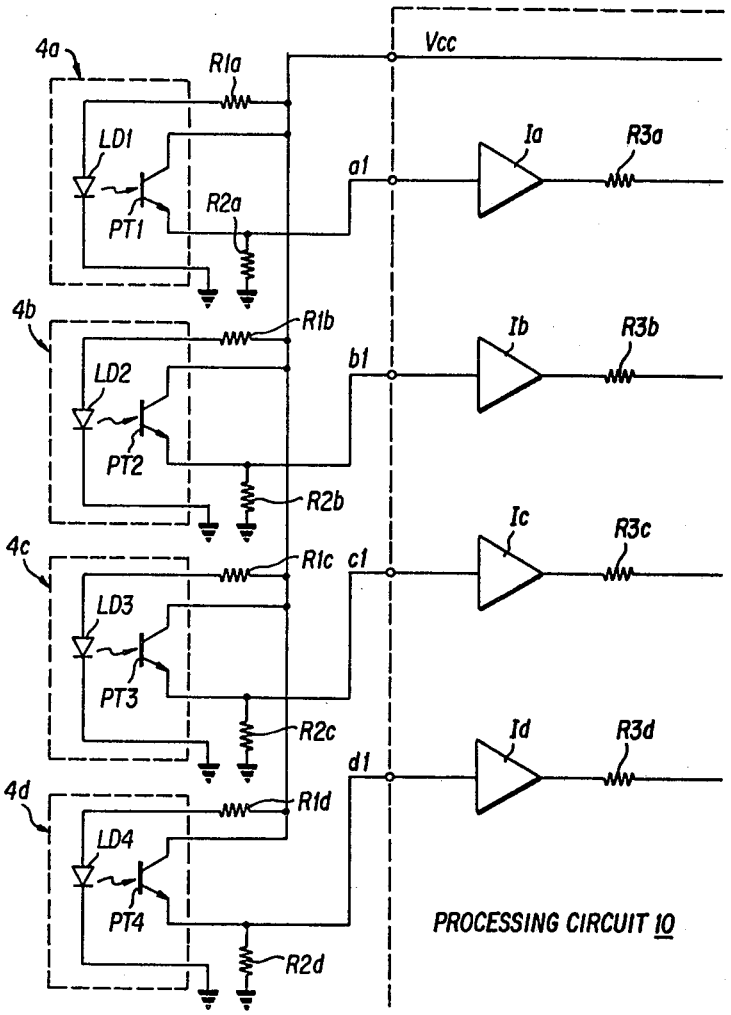
FIGS. 5A, 5B and 6 illustrate a first preferred embodiment of an ignition system according to the present invention.
Figure 5B:
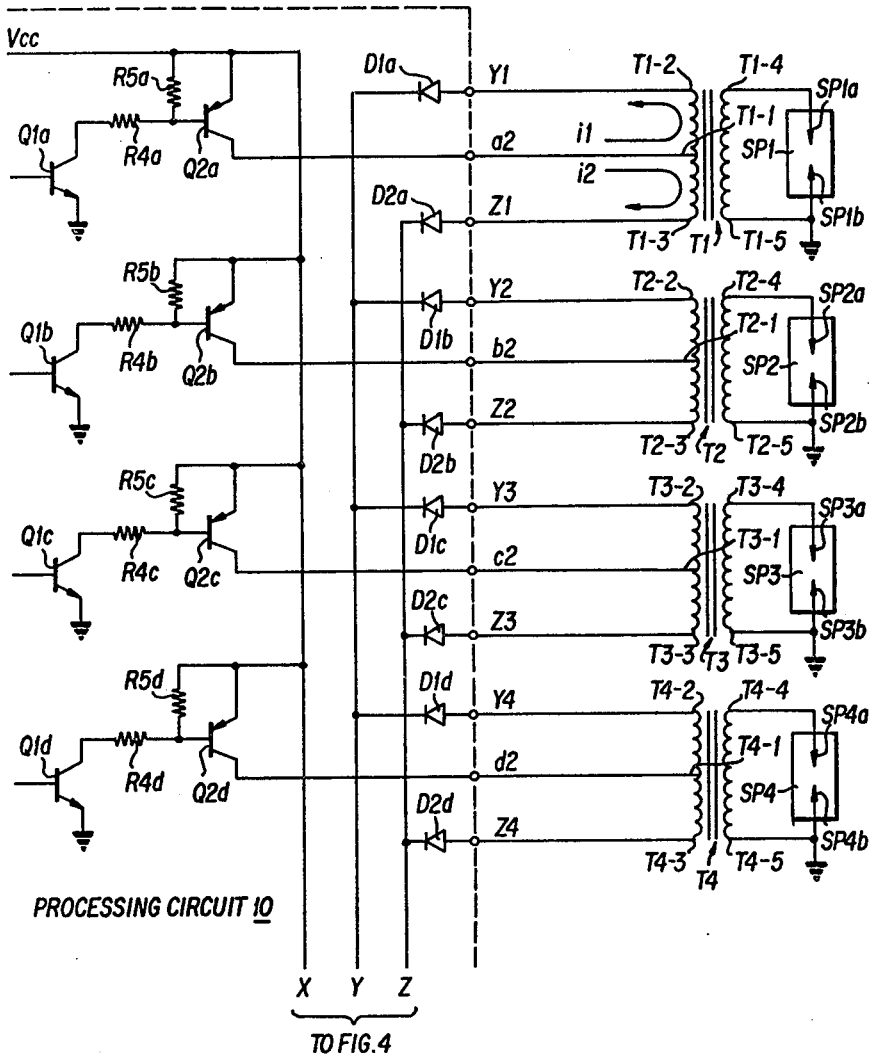
Figure 6:
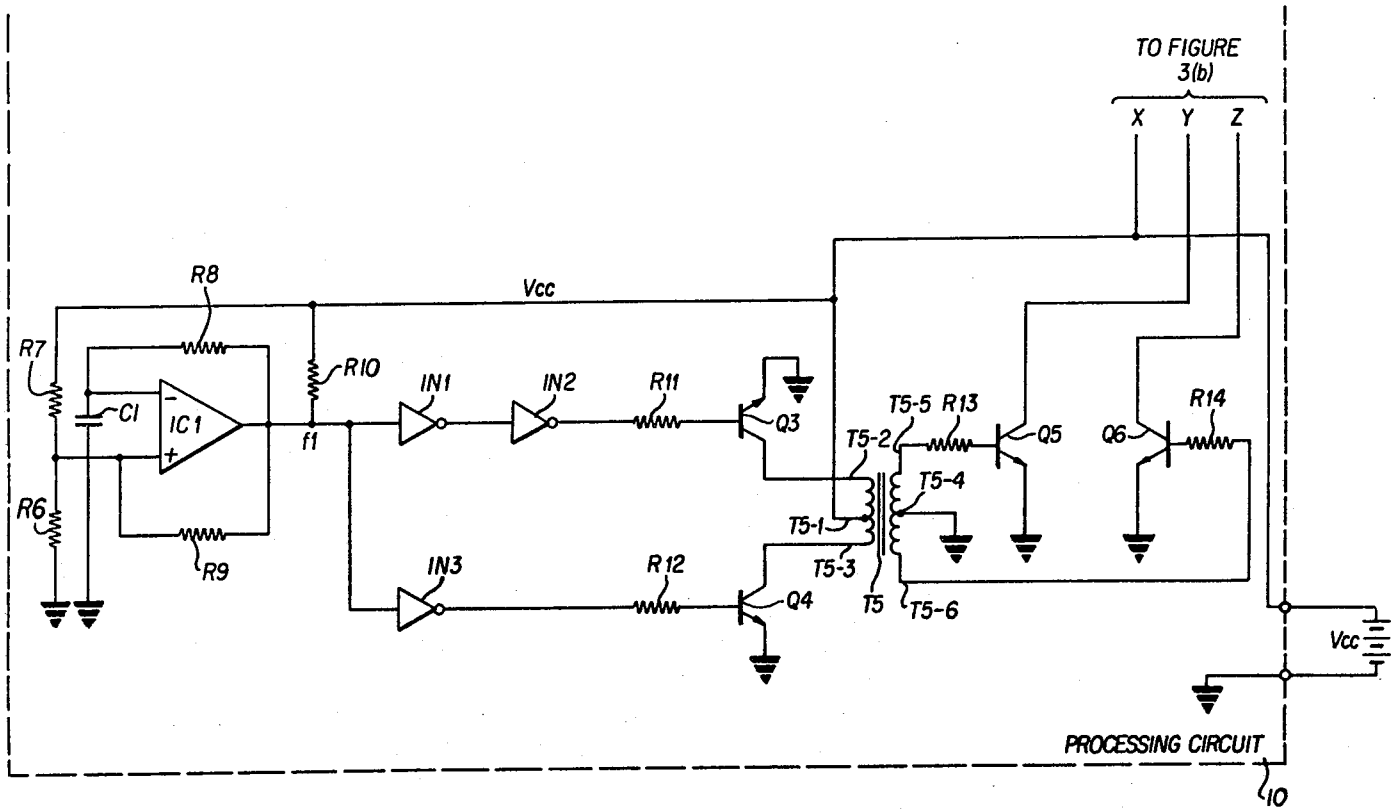

FIGS. 5A, 5B and 6 illustrate a schematic diagram of the ignition system according to the first preferred embodiment of the subject invention. The ignition system includes the four previously discussed photo-interrupters 4*a* through 4, a processing circuit 10, four ignition transformers T1 through T4, and four spark plugs SP1 through SP4.

The four light emitting diodes LD1 through LD4 of the photo-interrupters 4*a* through 4*d* are each coupled between ground and a positive DC voltage Vcc (vehicle battery) through series resistors R1*a* through R1*d*, respectively. Thus, the light emitting diodes remain on constantly so long as power is applied to the ignition system.

The collector of each photo transistor, PT1 through PT4, in the photo-interruptors 4*a* through 4*d* is coupled to the positive DC voltage Vcc, while the emitters are each coupled to ground through series resistors R2*a* through R2*d*, respectively. The signal appearing at the emitter of each photo transistor is at a high level when the shutter 2 allows light from the light emitting diodes to strike the photo-transistors. Thus, emitter signals a1 through d1 (henceforth referred to as timing signals a1 through d1) of the photo-transistors PT1 through PT4 are normally low and take on a high level when the opening 3 in the shutter passes through the respective photo-interruptor.

The timing signal a1 is coupled through the series combination of an isolation amplifier Ia and a resistor R3*a* to the base of a transistor Q1*a* which becomes turned on when the timing signal a1 is high. The collector of transistor Q1*a* is coupled to the base of a transistor Q2*a* through a series resistor R4*a*. The resistor R4*a* combines with a resistor R5*a* to bias transistor Q2*a* which is normally turned off when the timing signal a1 is at the low level. When transistor Q1*a* turns on, transistor Q2*a* likewise turns on thereby coupling the battery voltage Vcc to its collector. The collector of transistor Q2*a* is coupled to the center tap T1-1 of the primary winding of the ignition transformer T1. Therefore, the center tap T1-1 is coupled to the battery voltage Vcc when the timing signal a1 is at a high level corresponding to the passage of the opening 3 of the shutter 2 through the photo-interrupter 4*a*. Similarly, the timing signals b1 through d1 of the photo-interrupters 4*b* through 4*d* are coupled through the processing circuit 10 to supply the battery voltage Vcc to the center taps T2-1 through T4-1 of the primary windings of the ignition transformers T2 through T4, respectively.

As shown in FIG. 6, the processing circuit 10 additionally includes an operational amplifier IC1 which is connected to operate as an oscillator of well known design producing a square wave output signal f1 having a frequency of approximately 20 kHz. The operational amplifier IC1 can be any standard type such as one of the common 741 series. The resistor R7 supplies the battery voltage Vcc to the positive input of the operational amplifier IC1 and thus provides an input for the oscillator. The resistors R6 and R9 form a positive feedback network for IC1. The frequency of the square wave output of IC1 is controlled by the time constant product R8C1 of the negative feedback circuit.

The oscillator output signal f1 is coupled through the series combination of two inverters, IN1 and IN2, and resistor R11 to the base of a transistor Q3. The inverters IN1 and IN2 act to isolate the oscillator circuit, including the operation amplifier IC1, so as to enhance the stability of the oscillator. The transistor Q3 turns on when the oscillator signal f1 is at a high level, thereby coupling the terminal T5-2 of the primary winding of interstage transformer T5 to ground. The transistor Q3 is turned off when the oscillator signal f1 is at its low level.

Additionally, the oscillator signal f1 is coupled through the series combination of inverter IN3 and resistor R12 to the base of transistor Q4. The inverter IN3 acts to invert the oscillator signal f1 and to isolate the oscillator circuit. As such, transistor Q4 turns on when the oscillator output signal f1 is at its low level, thereby connecting the other terminal T5-3 of the interstage transformer T5 to ground.

The primary terminal T5-3 of the transformer T5 is thus coupled to ground when the oscillator output signal f1 is low and the primary terminal T5-2 is coupled to ground when the signal f1 is high. Thus, since the center tap terminal T5-1 of the primary winding of transformer T5 is connected to the battery voltage Vcc, a current flows from the terminal T5-1 to the terminal T5-2 when the signal f1 is high, and a current flows from the terminal T5-1 to the terminal T5-3 when f1 is low. Due to the current flowing in the primary circuit, a potential is included in the secondary winding of T5 such that the terminal T5-5 becomes positive with respect to the secondary center tap terminal T5-4, which is grounded, in synchronism with the positive pulses of the oscillator signal f1 while the terminal T5-6 of the secondary winding becomes positive in synchronism with the low levels of the signal f1.

The secondary terminal T5-5 is coupled through a series resistor R13 to the base of a transistor Q5 which turns on when the signal f1 is high, thereby coupling the signal line Y to ground. Similarly, the terminal T5-6 is coupled through the series resistor R14 to the base of a transistor Q6 which turns on thereby coupling the signal line z to ground when the signal f1 is low. Thus the signal lines Y and Z are alternatingly grounded at the rate of approximately 20 kHz which is the frequency of the oscillator signal f1.

The signal line Y is coupled via the diodes D1*a* through D1*d* to the first terminals T1-2 through T4-2, respectively, of the primary windings of the ignition transformers T1 through T4. The signal line Z is similarly coupled via the diodes D2*a* through D2*d* to the other terminals T1-3 through T4-3, respectively, of the primary windings of the ignition transformers T1 through T4. Therefore, the opposite end terminals of the primary winding of each ignition transformer T1 through T4 are alternatingly grounded at the rate of 20 kHz.

As previously explained, the timing signals a1 through d1 act to couple the battery voltage Vcc to the center taps T1-1 through T4-1 of the ignition transformers T1 through T4 for a time duration and in a time sequence as determined by the rotation of the shutter 2 past the photo-interrupter 4*a* through 4*d*. This results in an alternating flow of current through the primary windings of the ignition transformers under the control of the timing signals a1 through d1. For example, when the timing signal a1 is at its high level and the signal line Y is grounded, a current $i_1$ flows through the primary winding of the ignition transformer from the battery Vcc through the center tap T1-1 to the end terminal T1-2 and thenceforth through the diode D1*a* to ground via the signal line Y. Similarly, when the timing signal a1 is high and the signal bus Z is grounded, a circuit $i_2$ flows from the battery Vcc through the terminals T1-1 and T1-3 of the transformer T1 to ground via the diode D2*a* and the signal line Z. Since the ignition transformer T1 (and transformers T2 through T4) is a high voltage step-up device having a turns ratio of approximately 300 to 1, the currents $i_1$ and $i_2$ act to induce high potentials in the secondary winding of the transformer. Thus, the current $i_1$ induces a high voltage in the secondary such that the terminal T1-4 becomes positive with respect to the terminal T1-5. When this voltage becomes sufficiently high, an arc occurs between the electrodes SP1*a* and SP1*b* of the spark plug SP1 connected across the secondary terminals T1-4 and T1-5 of the ignition transformer T1. When the current $i_1$ ends and the current $i_2$ begins, the polarity of the induced voltage in the secondary winding reverses and the arc ends. The voltage of the terminal T1-5 thus becomes positive with respect to the terminal T1-4 and the spark plug reignites with an arc now flowing between the electrodes SP1*b* and SP1*a*. Since the signal lines Y and Z are alternatingly grounded at the 20 kHz rate of the oscillator signal f1, the primary currents $i_1$ and $i_2$ alternate at the rate of 20 kHz and thus a plurality of arcs alternating at a 20 kHz rate occur at the spark plug electrodes for the duration of the time during which the timing signal a1 is at the high level. Similarly, arcing is produced across the electrodes of spark plugs SP2 through SP4 for the duration of timing signals b1 through d1, respectively.

Figure 7:
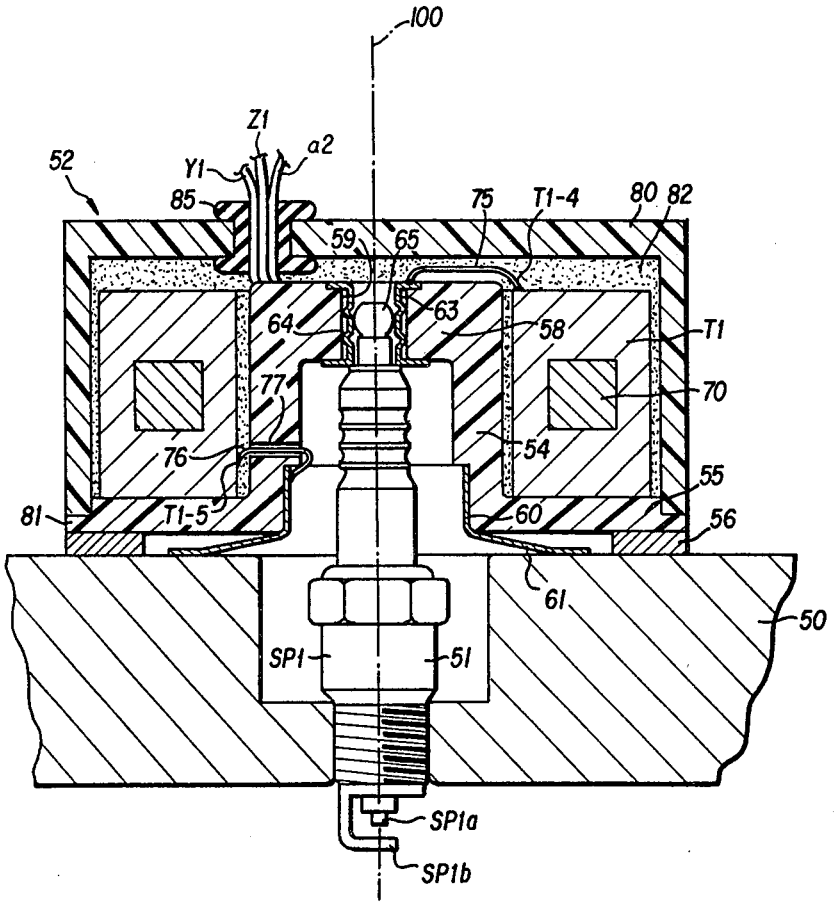
FIG. 7 is a side view, partially in cross-section, of an ignition transformer and spark plug assembly according to a first embodiment of the invention.
Figure 8:
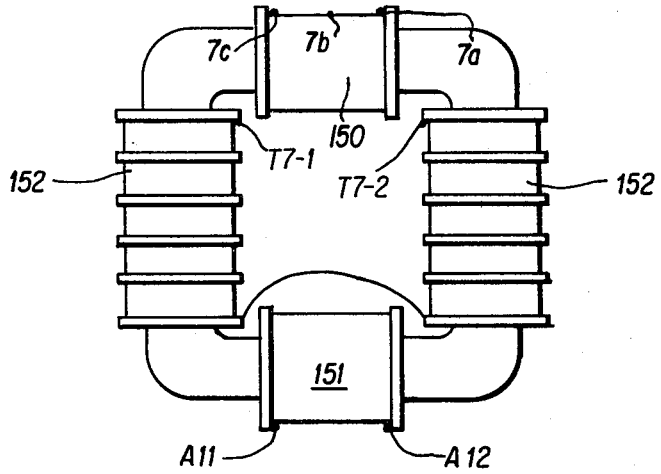
FIG. 8 is a plan view of an ignition transformer used in the embodiment shown in FIG. 7.

FIGS. 7 and 8 illustrate a preferred embodiment of a novel ignition transformer utilized with the ignition system of the subject invention. This device is utilized to form the ignition transformer T1 through T4 shown in FIG. 5. For convenience, the ignition transformer will be assumed to be transformer T1.

In FIG. 7, the spark plug SP1 including the plug electrodes SP1*a* and SP1*b* is shown as being installed in the head 50 of an engine. Surrounding the portion 51 of the spark plug SP1 extending from the head 50 is a combination plug cover and ignition transformer assembly (hereinafter referred to as the combination assembly) generally designated as 52 and illustrated in cross-section. Positioned within the combination assembly 52 is a generally hollow cylindrical insulating member 54 which includes a flat circular base member 55 integrally attached to the base of the cylindrical member 54 and lying in a plane normal to the central axis 100 of the cylindrical member. A ring-shaped flange member 58 including a circular opening 59 therethrough is integrally attached to the upper portion of the cylindrical insulating member 54. The cylindrical member 54 and its integral base member 55 and flange member 58 are made from a strong, high dielectric strength material such as epoxy glass or silicone plastic.

Affixed to the lower surface of the base member 55 is a ring-shaped resilient gasket member 56, made from silicone rubber or equivalent material, which forms a moisture proof seal with the external surface of the head 50. Additionally, affixed to the inner surface of the cylindrical member 54 is a cylindrical metal flange member 60 which includes an integral ring-shaped skirt 61. The flange member 60 and its skirt 61 are made from a springy conduction material such as a beryllium copper alloy. When the combination assembly 52 is in place surrounding the spark plug SP1, the skirt 61 is bent upward slightly by its contact with the surface of the head 50 and thus remains under tension thereby encouraging a good electrical contact with the head 50.

Positioned within the opening 59 in the flange member 58 and attached thereto is a generally cylindrical, hollow resilient terminal member 63 which includes a plurality of corrugations 64 in its cylindrical wall. The terminal member 63 is formed from a springy conductive metal such as the above-mentioned beryllium copper alloy. The terminal member 63 contacts the external surface of the upper terminal 65 of the spark plug SP1 and is removably affixed thereto due to the resilience of its material and the corrugations 64. The contact between the terminal member 63 and the upper terminal 65 of the spark plug acts to locate and hold the combination assembly 52 in place.

Located concentrically with the cylindrical member 54 and resting on the upper surface of the flange member 55 is the ignition transformer T1. A top view of the transformer T1 is illustrated in FIG. 8. The transformer includes a generally rectangular core 70 having a square cross-section. The core is made from high permeability material such as ferrite or is formed from a plurality of turns of a magnetically soft amorphous metal tape. Wound about the core 70 are the primary and secondary windings P1 and S1. Each winding P1, S1 has been divided into two coils P1*a*, P1*b* and S1*a*, S1*b*, respectively, for reasons of space utilization. Thus primary coils P1*a* and P1*b* are joined by a jumper 71, and the secondary coils S1*a*, S1*b* are joined by a jumper 72. The coils are wound on conventional high dielectric strength bobbins 74*a* through 74*d* as is well known in the art.

Returning to FIG. 7, the first terminal T1-4 of the secondary winding of the ignition transformer T1 is coupled to the terminal member 63 by means of a jumper 75 attached thereto by welding or soldering. Similarly, the second terminal T1-5 is coupled to the resilient flange member 60 by means of a jumper 76 attached thereto by welding or soldering. The jumper 76 passes through a hole 77 in the cylindrical member 54 as shown.

The entire combination assembly 52 is surrounded by a cover 80 made from a strong, high dielectric strength material such as epoxy glass or silicone plastic. The cover 80 is bonded to a lip 81 of the base member 55 thereby sealing the combination assembly 52 against moisture. Spaces within the interior of the cover 80 are filled with a potting material 82 such as silicone rubber. The primary leads Y1, Z1 and a2 enter the combination assembly 52 through a grommet 85 positioned within an opening in the cover 80.

The combination spark plug cover and ignition transformer assembly 52, as shown in FIG. 7, provides distinct advantages when used in conjunction with an ignition circuit such as that shown in FIGS. 5A, 5B and 6. Since the ignition transformer is positioned immediately adjacent to the spark plug it serves, all high voltage wires are eliminated along with their well known problems such as high voltage leakage and radio frequency interference (RFI). The power and control conductors for the ignition transformer all carry low voltages. Thus moisture and dirt related problems are virtually eliminated and radio frequency interference problems are substantially reduced. The interference problems can be further reduced by twisting and/or shielding the power and control leads. Furthermore, since the high voltage leads are eliminated, the rise time of the arc current within the spark plug can be greatly improved because the inductive and capacitive effects of the high voltage leads no longer exist. Additionally, the use of the continuous rectangular core within the ignition transformer results in a reduction in radio frequency interference problems due to the inherent self-shielding properties of toroidal-shaped coils.

Nextly, a second preferred embodiment of an ignition system according to the present invention will be described with reference to FIGS. 9 through 12. Portions of this system are identical to the previously discussed system and are designated with the same reference numerals previously utilized.

Figure 9:
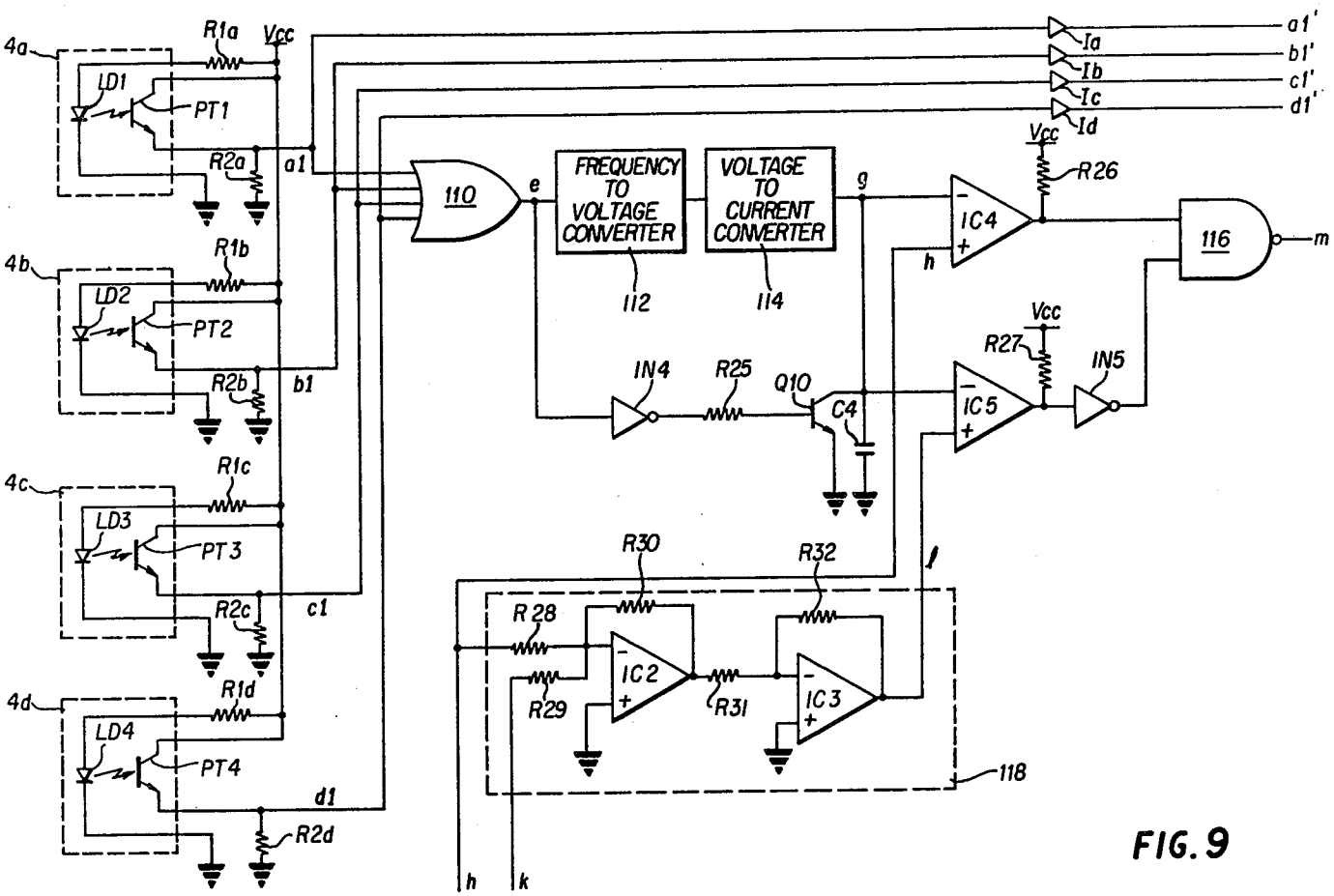
FIGS. 9 and 10 illustrate a second preferred embodiment of an ignition system according to the present invention.

In FIG. 9, the four photo-interrupters 4*a* through 4*d* produce the four timing signals a1 through d1. The timing signals determine which spark plug is to be ignited. The time sequence of the timing signals a1 through d1 is illustrated in the timing chart of FIG. 10. The timing signals a1 through d1 pass through four buffer amplifiers I*a* through I*d* to produce the buffered timing signals a1′ through d1′ which are essentially identical to the timing signals a1 through d1.

Additionally, the timing signals a1 through d1 are coupled to the input of an OR gate 110. The output signal e of the OR gate is at a high level when any of the timing signals a1 through d1 is high as shown in the timing diagram of FIG. 10. The signal e is coupled to a frequency to voltage converter 112 which produces an output signal having a voltage proportional to the frequency of the signal e. The output of the frequency to voltage converter 112 is coupled to the input of a voltage to current converter 114 which produces a current proportional to the output of the frequency to voltage converter 112. Thus the output current of the converter 114 is proportional to the frequency of the signal e and thus is proportional to the speed of rotation of the engine.

Figure 12:
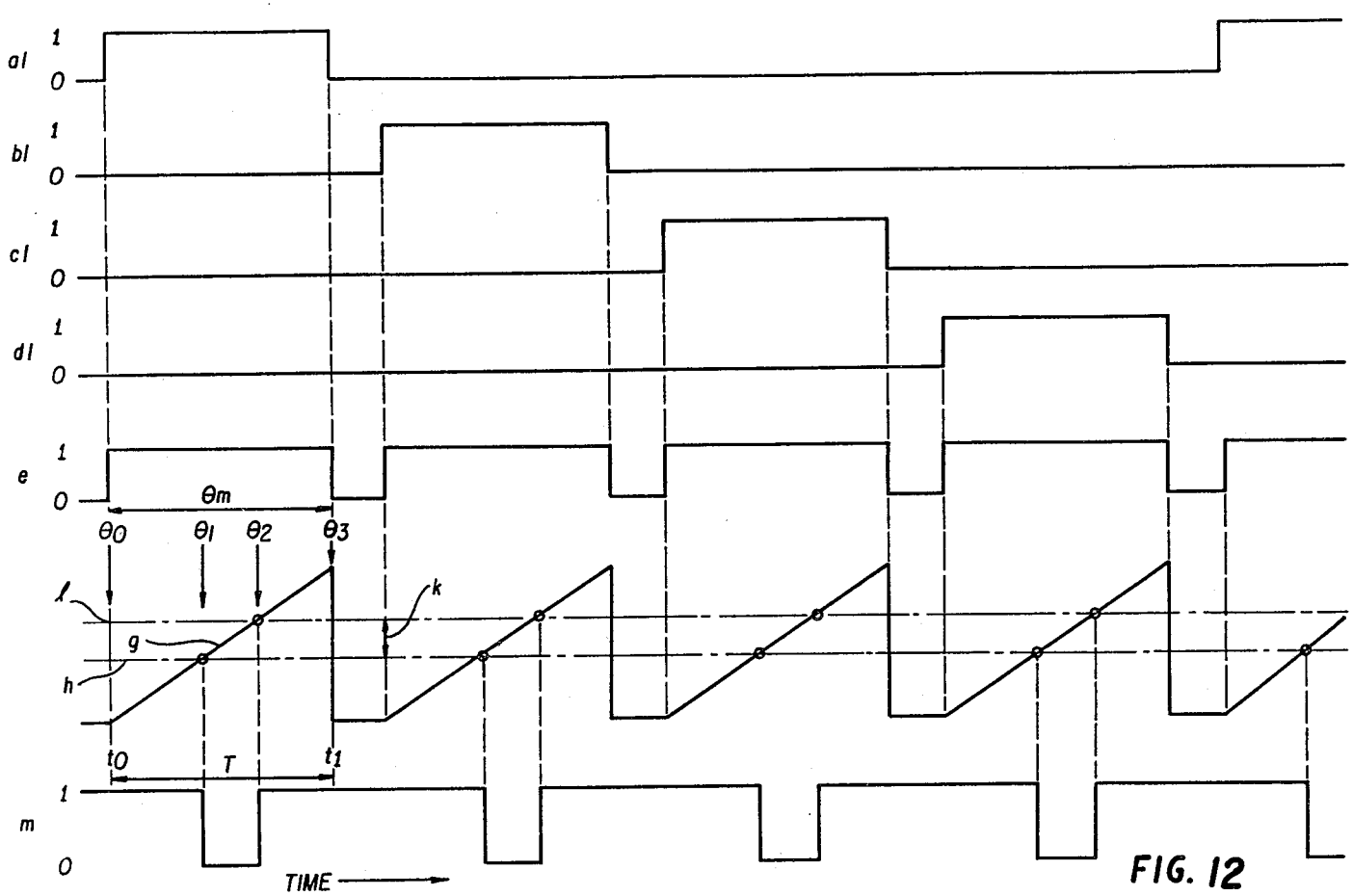
FIG. 12 is a timing chart illustrating various waveforms appearing in the ignition system shown in FIGS. 9 and 10.

The output current of the voltage to current convert 114 is coupled to a capacitor C4 which is charged by the current to produce a voltage signal g as shown in the timing chart of FIG. 12. The signal e is, additionally, coupled through the series combination of an inverter IN4 and a resistor R25 to the base of a transistor Q10 which shunts the capacitor C4. The capacitor C4 is shorted by the transistor Q10 when the signal e is at a low level indicating that the timing signals a1 through d1 are at the low level. The capacitor C4 is allowed to charge only when one of the timing signals a1 through d1 is high. Thus the voltage signal g is a sawtooth waveform which starts at time to and ends at time tl as shown in FIG. 12. Since the time (tl−t$\theta$) is inversely proportional to the frequency of the signal e and the time rate of increase of the voltage g is directly proportional to the frequency of the signal e, the saw tooth waveform g maintains a constant shape regardless of the frequency of the signal e or regardless of the rotational speed of the engine. The amplitude of the waveform g at any particular time represents an angle of rotation of the shutter 2 beginning with $\theta$o when the leading edge 3'of the opening 3 passes through the center of the photo-interrupter and ending with $\theta$3 when the trailing edge 3''of the opening 3 passes through the photo-interrupter as shown in FIGS. 3 and 12.

Returning to FIG. 9, the sawtooth signal g is coupled to a first comparator IC4 where it is compared to a voltage h and is coupled to a second comparator IC5 where it is compared to a voltage 1. The first comparator IC4 produces an output of "1" when $g<h$ and an output of "0" when $g>h$. Similarly, the second comparator IC5 produces an output of "1" when $g<1$ and an output of "0" when $g>1$. The output of the first comparator IC4 is coupled to the input of a NAND gate 116; while the output of the second comparator IC5 is coupled through an inverter IN5 to an input of the NAND gate 116. The output m of the NAND gate 116 is normally "1" and becomes "0" only when the condition $h<g<1$ exists.

Reference numeral 118 represents an adder circuit, including operational amplifier IC2 and IC3, which generates the voltage 1 by adding the voltage h to a voltage k ($1=h+k$).

As will be described in detail below, when the output of the NAND gate 116 becomes "0" one of the spark plugs SP1 through SP4 is ignited. The starting point of ignition is the angle $\theta$1 shown in FIG. 12 which corresponds to the rotational angle through which the leading edge 3' of the shutter 2 has rotated since the edge 3' passed through the photo interrupter. Thus the voltage h determines the rotational angle of the crankshaft at which the spark ignition begins and thus the ignition advance of the engine. Similarly, the angle $\theta$2 represents the end of the ignition pulse as determined by the voltage 1. Thus the angular duration of the ignition is $\theta_2-\theta_1$ and is determined by the voltage $k(=1-h)$. In FIG. 3, the symbols A through D represent the top dead center points of the engine. The angle $\theta_m$ represents the angle between the top dead center A and the center of the photo-interrupter 4*a* and is generally known as the maximum advanced position. In FIG. 12, $\theta_2-\theta_o$ $(=\theta_m)$ represents the angular opening 3 in the shutter 2. Thus the angle $\theta_3-\theta_1$ represents the advance of the engine. Therefore, when $\theta_1$ is determined, by the voltage h, the general "advance" of the engine can be determined.

The voltage h which determines the advance of the engine and the voltage k which determines the duration of the ignition are inputs to the ignition system of the subject invention. These inputs may be fixed voltages or they may be variable based upon certain of the operating parameters of the engine, such as manifold vacuum, torque, speed, as is well known in the art.

Figure 11:
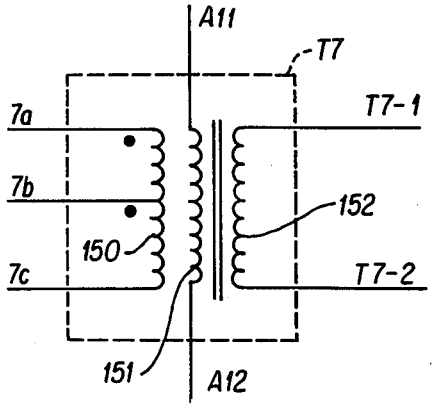
FIG. 11 illustrates an ignition transformer for use with the ignition system shown in FIGS. 9 and 10.
Figure 10:
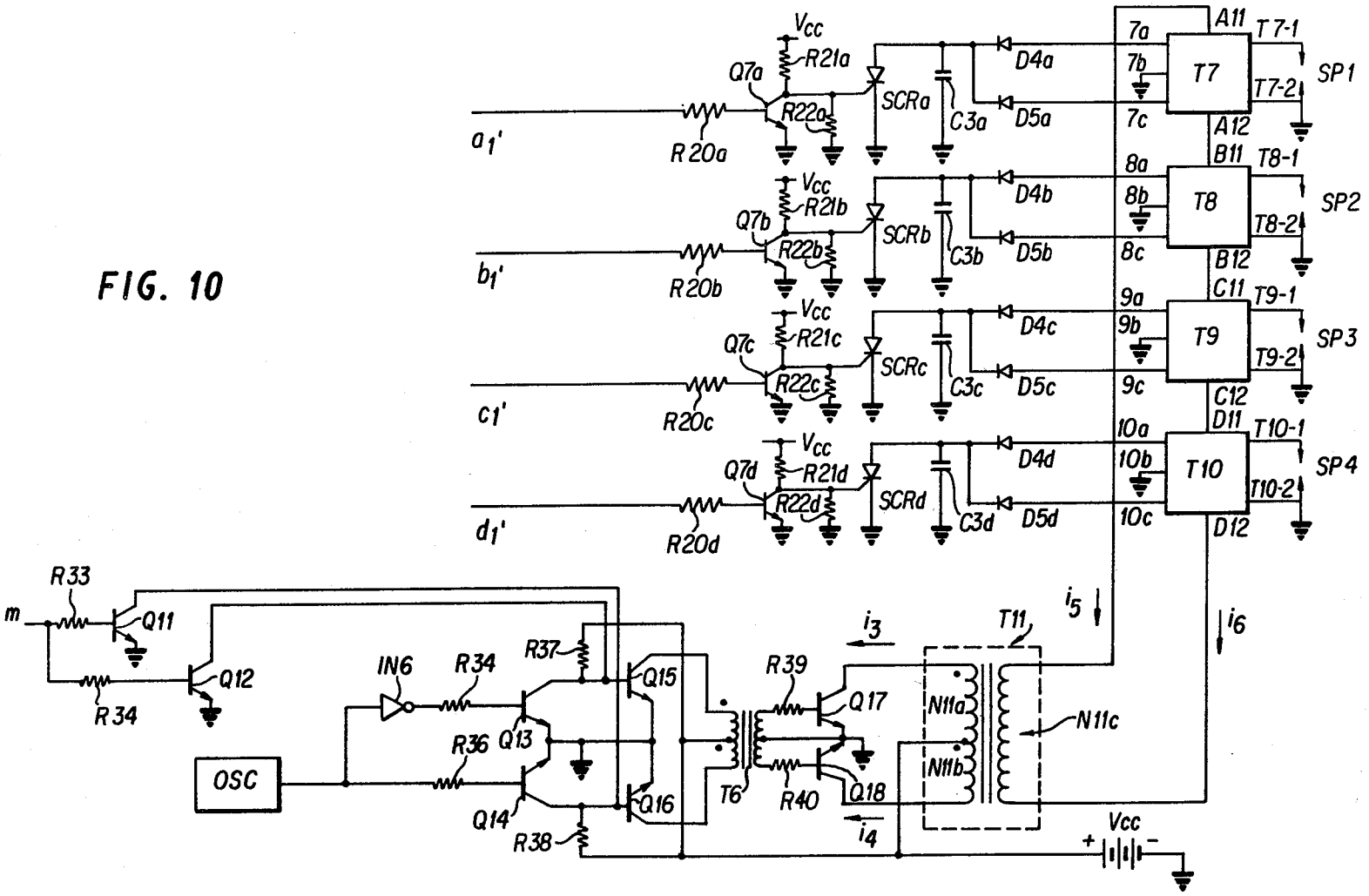

Referring now to FIG. 10, the buffered timing signals a1' through d1' are coupled through resistors R20*a* through R20*d*, respectively, to the bases of transistors Q7*a* through Q7*d*, respectively. The transistors Q7*a* through Q7*d* are individually turned on when the respective timing signal a1 through d1 is at a high level. For example, when the timing signal a1 is high, transistor Q7*a* is turned on and the silicon controlled rectifier SCRa, coupled to the collector of Q7*a*, is turned off. When SCRa is off, ignition is possible in the cylinder served by spark plug SP1. On the other hand, when the timing signal a1 is at a low level, transistor Q7*a* is turned OFF and the SCRa is turned on. When SCRa is turned on, conductors 7A and 7B are grounded through the diodes D4*a* and D5*a* thereby grounding the end terminals of the center tapped control coil 150 in the ignition transformer T7. FIG. 11 illustrates the electrical structure of the ignition transformer T7 which will be discussed further below. The ignition transformers T7 through T10 are identical. When the control coil 150 of ignition transformer T7 is grounded via SCRa, changes in the magnetic flux in the ignition transformer's core 160 are prevented thereby preventing the induction of high voltage into the secondary winding 152. The other ignition transformers T8 through T10 are controlled via SCRb through SCRd, respectively.

As seen in FIG. 12, only one timing signal a1 through d1 is at a high level at any particular time. Thus all the control coils in the ignition transformers T7 through T10 are grounded except for one as determined by the high timing signal. Thus a high voltage can only be induced in the secondary winding of the ignition transformer controlled by the high timing signal.

The capacitors C3*a* through C3*d* and the diodes D4*a* through D4*d* and D5*a* through D5*d* function as smoothing circuits for the silicon controlled rectifiers SCRa through SCRd.

The output m of the NAND gate 116 is coupled through resistors R33 and R34 to the bases of a pair of transistors Q11 and Q12. The collectors of Q11 and Q12 are respectively coupled to the bases of transistors Q15 and Q16. When the NAND gate output m is high, the transistors Q11 and Q12 are turned ON thereby forcing the transistors Q15 and Q16 to be OFF.

An oscillator 118 generates a square wave signal f2 having a frequency of between 15 and 30 kHz. The square wave signal f2 is coupled to the base of a transistor Q14 through a resistor R36 and to the base of a transistor Q13 through an inverter IN6 and a resistor R35. The transistors Q13 and Q14 thus alternatingly turn on and off at the frequency of the square wave signal f2. The collectors of transistors Q13 and Q14 are coupled to the bases of transistors Q15 and Q16, respectively, thereby alternatingly turning the transistors Q15 and Q16 ON and OFF at the rate of signal f2 when the signal m is at its low level. As previously mentioned, the transistors are turned off or inhibited when the signal m is high. When the signal m is low, the square wave signal is coupled from the alternating transistors Q15 and Q16 through the transformer T6 to the bases of transistors Q17 and Q18 which alternatingly turn on and off with the signal f2.

The collectors of transistors Q17 and Q18 are coupled to opposed ends of the respective primary windings $N_{11a}$ and $N_{11b}$ of a leakage transformer $T_{11}$. The junction between the other ends of the primary windings $N_{11a}$ and $N_{11b}$ are coupled to the battery Vcc. The secondary winding $N_{11c}$ of transformer $T_{11}$ has opposed ends coupled to a series connection of respective control windings 151 included in each of the ignition transformers $T_7$–$T_{10}$ shown in FIG. 10.

FIG. 11 illustrates in more detail the structure of each of the several ignition transformers $T_7$. Transformers $T_8$–$T_{10}$ have identical structures. Transformer $T_7$ is seen to include a control winding 150 having end connectors *7a* and *7c*, a centertap *7b*, and a high voltage secondary winding 152 connected to terminals $T_{7\text{-}1}$ and $T_{7\text{-}2}$ as shown. The control winding and the secondary winding of each ignition transformer is wound on a common core 160, along with a primary winding 151. As above indicated, the primary windings 151 of each of transformers $T_7$–$T_{10}$ are connected in series across the secondary winding $N_{11c}$ of leakage transformer $T_{11}$.

In operation, when the signal m is low, the transistors Q17 and Q18 alternatingly conduct currents $i_3$ and $i_4$, respectively, from the battery Vcc to ground through the primary windings $N_{11a}$ and $N_{11b}$. Currents $i_3$ and $i_4$ induce corresponding currents $i_5$ and $i_6$ in the secondary $N_{11c}$ of leakage transformer $T_{11}$, which in turn pass through the series connection of the primary windings 151 of each of the transformers $T_7$–$T_{10}$. Thus, when one of the timing signals a1 through d1 is high, the control winding 150 of the ignition transformer associated with the high timing signal is open circuited thereby enabling the transformer. The alternating current i5 and i6, occurring when m is low, act to induce a high voltage in the secondary winding 152 of the ignition transformer associated with the high timing signal via the primary winding 151 thereof, thereby causing the spark plus connected to the secondary winding to ignite.

As is evident from FIGS. 10 and 11, when the transformer is enabled via the control winding 150 and when the currents i5 and i6 are flowing, an alternating voltage is induced into the secondary 152 having a frequency equal to that of the oscillator square wave output signal f2. Since the ignition transformer has a primary to secondary turns ratio of 1 to 300, the alternating voltage across the secondary 152 has a very high amplitude which causes the spark plug connected to the transformer to repeatedly arc at the rate of the frequency of the signal f2.

Of particular interest in the ignition circuit shown in FIG. 10 is the provision of the leakage transformer T11 which is provided in order to increase the useful working life of the spark plug, according to the invention. In this regards, it is noted that when a discharge is initiated across the electrodes of the spark plug, initially a relatively large voltage is required in order to overcome the insulating effect of the gas within the engine cylinder between the electrodes of the spark plug in order to ionize the gas therebetween. For example, typically a voltage as high as 15–30 KV is required to achieve complete ionization whereby the spark discharge is initiated. However, once a discharge is initiated, a relatively low voltage, at most 1 KV, is needed to maintain the discharge. Under such circumstances, i.e. after the initial discharge and when the gas between the spark plug electrodes is ionized, if the output voltage is maintained high (15–30 KV), an extremely large current is generated, which can damage the electrodes of the spark plug.

Figure 1:
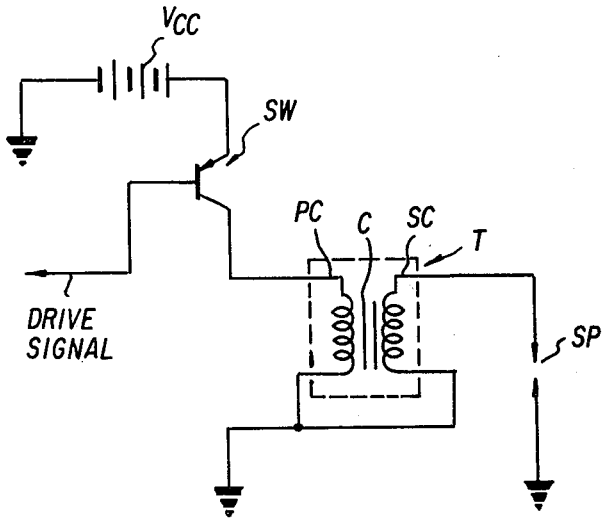
FIG. 1 PRIOR ART
FIG. 1 is a simplified circuit diagram of a conventional ignition circuit.
Figure 13A:
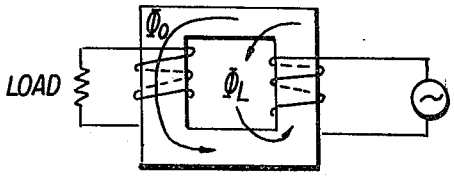
FIG. 13*a* is a schematic diagram illustrating the leakage phenomena characteristic of conventional transformers.
Figure 13B:
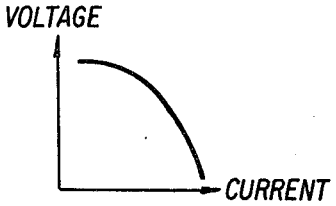
FIG. 13*b* is a graph of the voltage versus current characteristic of the conventional transformer shown in FIG. 13*a;*

The above described possibility of producing excessively large currents in an ignition transformer secondary winding after initial ionization between the electrodes of the spark plug is avoided in the conventional ignitions system as shown in FIG. 1 due to the existence of leakage currents developed in the conventional ignition transformer, as schematically illustrated in FIG. 13*a*. In this figure, in addition to the main flux, $\Phi_0$, an additional leakage flux, $\Phi_1$ leaks across the gap separating the primary winding coil PC and the secondary winding coil SC, resulting in the voltage versus current graph shown in FIG. 13*b*. When the load is small (small current), a high output voltage is generated which results in the initial discharge across the spark plug electrode and ionization of the gas therebetween. However, when the load becomes large, i.e. a large current is produced in the secondary winding coil SC, due to leakage effects the output voltage is reduced, thereby limiting the flow of current in the secondary circuit.

The present invention recognizes the desirability of providing a leakage path to minimize currents in the secondary circuit of the ignition transformer after initial discharge and ionization of the gas between the spark plug electrodes. Conceptually, the simplest way to achieve this is to provide each of the ignition transformers $T_7$–$T_{10}$ with a built-in leakage transformer structure. However, since one of the objects of the invention is to minimize the size of the ignition transformer/plug structure and to install the ignition system of the invention in a very limited space in the engine compartment of an automobile, it is not desirable to provide each of the ignition transformers $T_7$–$T_{11}$ with leakage structure since this increases size of the ignition transformers. Such ignition transformers would indeed be too large for practical use. Therefore, from a practical standpoint, the present invention is implemented in order to minimize the size of transformers $T_7$–$T_{10}$ thereby to increase the magnetic coupling between the low voltage primary winding 151 and the high voltage secondary winding 152 (FIG. 11) while also providing structure in the form of leakage transformer T11 providing a leakage path whereby excessive secondary currents can be avoided after initial discharge and ionization occurs between the electrodes of the spark plug. According to the invention, the primary and secondary coils 151, 152 of each of the ignition transformers $T_7$–$T_{10}$ are disposed quite close to each other to minimize magnetic leakage and the leakage transformer T11 is provided to provide power to each of the ignition transformers $T_7$–$T_{10}$.

Conceiveably, another way of limiting the secondary currents from become excessive after initial discharge is to insert thermistors having a positive temperature coefficient in the collector circuits of transistors Q15 and Q16 of the FIG. 8 embodiment shown in parent application Ser. No. 268,889. In such an implementation, the larger currents generated would cause joule heating of the thermistors, a corresponding increase in the resistance thereof and therefore a corresponding decrease in the secondary currents. However, in such a system, heat loss of approximately 500–1,000 W results, thereby decreasing reliability and also efficiency.

Therefore, in order to enable the provision of small ignition transformers $T_7$–$T_{10}$ which can be mounted compactly on spark plugs appropriately positioned in an internal combustion engine and to prevent the plugs and transformers from generating heat, the leakage transformer T11 is provided by which power is supplied to each of the ignition transformers $T_7$–$T_{10}$. Since the voltage is generated by the transformer $T_{11}$ are relatively low, the leakage transformer $T_{11}$ can be placed anywhere in the engine compartment and can be sized accordingly.

Figure 14A:
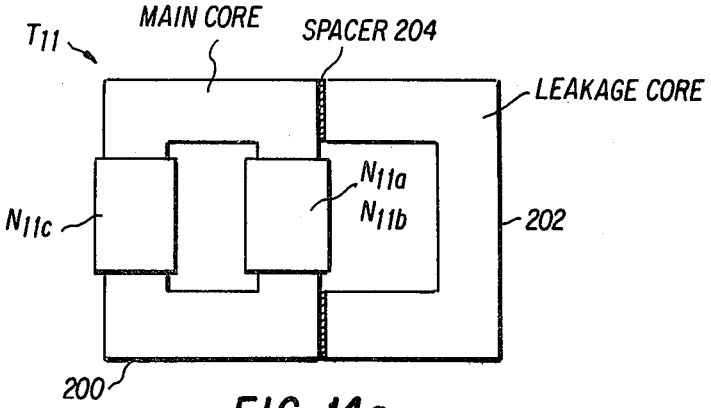
FIG. 14*a* is a schematic side view of one embodiment of a leakage transformer which can be used in accordance with the invention.
Figure 14B:
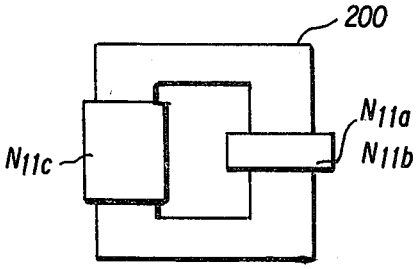
FIG. 14*b* is a side view of another leakage transformer which can be used in accordance with the invention.

FIGS. 14*a* and 14*b* illustrate various implementations for the leakage transformer $T_{11}$. In FIG. 14, a leakage transformer $T_{11}$ includes a main core 200 which forms a main magnetic flux circuit $n_{11c}$, $n_{11a}$, $n_{11b}$, and a leakage core 202 connected to the main core 200 by means of a non-magnetic spacer 204 to form a magnetic leakage circuit in parallel with the main magnetic flux circuit. In the embodiment shown in FIG. 14*a*, the amount of current flow upon discharge across the spark plug electrodes is determined by the thickness of the spacer, which can be predetermined in accordance with the characteristics of a particular spark plug to be used. Thus, since the value of current flow is constant within a wide range of power sources and voltages, if the value of current flow is properly set by the thickness of the spacer, a stable amount of current is supplied to the plugs even under very cold weather conditions during which the battery voltage is apt to drop enormously, or even under very hot weather conditions in which large voltage increases are encountered. Ignition is therefore reliably operated even at starting under very cold weather conditions, yet the plugs will not be subjected to excessive temperatures even upon starting at high temperatures.

FIG. 14*b* is another leakage transformer in which primary windings $n_{11a}$, $n_{11b}$ are wound on a main core 200 along with a secondary winding $n_{11c}$. This leakage transformer operates similarly to the conventional ignition transformer as shown in FIG. 13*a*, as described above. Further description thereof is therefore omitted.

Figure 15A:
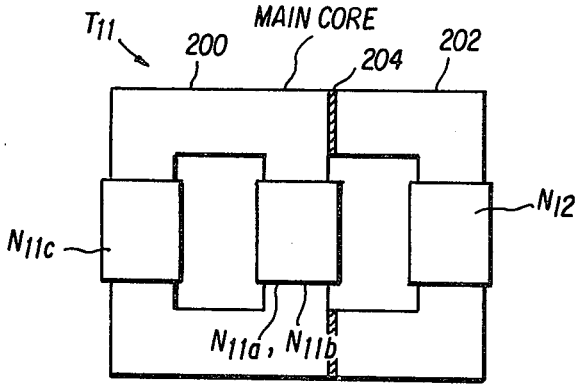
FIG. 15*a* is a schematic side view of another leakage transformer which can be used in accordance with the invention.
Figure 15B:
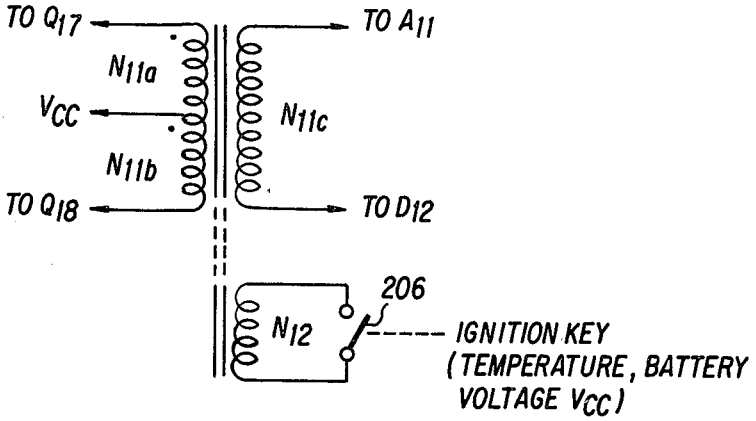
FIG. 15*b* is a circuit diagram of the leakage transformer shown in FIG. 15*a;*

Another highly useful leakage ignition transformer for use in accordance with the invention is illustrated in FIG. 15*a* and FIG. 15*b*. As shown in FIG. 15*a*, as in the leakage transformer shown in FIG. 14*a*, primary windings $n_{11a}$, $n_{11b}$ are wound on a main core 200 along with a secondary winding coil $n_{11c}$. Leakage core 202 is coupled to the main core 200 by means of a spacer 204. However, in the embodiment shown in FIG. 15*a*, a third winding $n_{12}$ is wound on the leakage core and as shown in FIG. 15*b* the winding $n_{12}$ is connected to a switch 206. With this embodiment, the switch 206 may be shorted to reduce the leakage effect. Thus, the switch 206 shown in FIG. 15*b* is typically closed upon starting at low temperatures in cold weather to provide a strong current (energy) to the spark plugs to achieve quick and reliable starting under very cold conditions when the battery voltage is typically lower than normal. Switch 206 naturally can be manually operated, or otherwise automatically operated under the control of a temperature sensor (not shown) and/or a battery voltage sensor (not shown).

Nextly decribed is a further refinement of the invention involving the structure of the ignition transformers $T_7$–$T_{10}$ as above described. This further refinement is first generally described by comparing the ignition circuit of the invention shown in FIG. 2 with that of the conventional ignition circuit shown in FIG. 1. As was previously discussed, FIG. 1 shows a conventional type ignition coil, in which a current is introduced in the primary winding coil PC of the ignition transformer T from a battery Vcc through a switch 6 during a non-discharge period. Energy of the ignition current is accumulated within the magnetic core C of the ignition transformer T as magnetic energy and discharged through the secondary winding coil SC to the spark plug SP during the discharge period. The present invention as shown in FIG. 2 envisions an ignition system in which each ignition transformer is built into a spark plug cover, thereby eliminating the need for a conventional electrical distributor. However, in the FIG. 2 ignition system, since the value of the density of the saturation flux in the magnetic core and the value of electrode-magnetic energy accumulated in the magnetic core are limited, it is impossible to reduce the cross-sectional area of the magnetic core so as to reduce the entire ignition coil structure.

In FIG. 2, the transformer of the present invention is seen as including a primary winding coil PC′ a secondary winding coil (high voltage) SC′ and a core C′. The low voltage coil PC′ is actuated by the AC source OSC and a discharge is initiated across the electrodes of the spark plug SP in accordance with the turns ratio of the coils PC′ and SC′. Whereas in the FIG. 1 ignition circuit, the size of the core C is determined by the amount of electrode-mechanical energy, in the FIG. 2 ignition circuit of the invention, the cross-sectional area S of the core C′ is defined as follows:

ti $S=KE_1/fB_sN_1$ wherein, f=actuating frequency $E_1$=actuating voltage (primary winding coil PC′)

$B_s$=density of saturation flux of core C′, and $N_1$=the number of turns of the primary winding PC′.

According to the invention, when the frequency f becomes high, then the area S of the core can be made smaller. In other words, energy accumulation is not necessary in the ignition transformer of FIG. 2, and the core C′ is considered to be an energy transmitting means. When the current flows through the primary winding coil PC′, energy is introduced into the secondary winding coil SC′.

Figure 18:
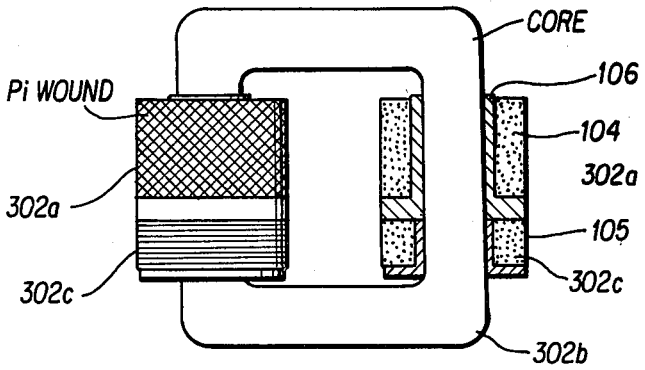
FIG. 18 is a side view, partially in cross-section, illustrating the windings of one of the individual transformers interconnected with like such transformers as shown in FIGS. 16 and 17.
Figure 16:
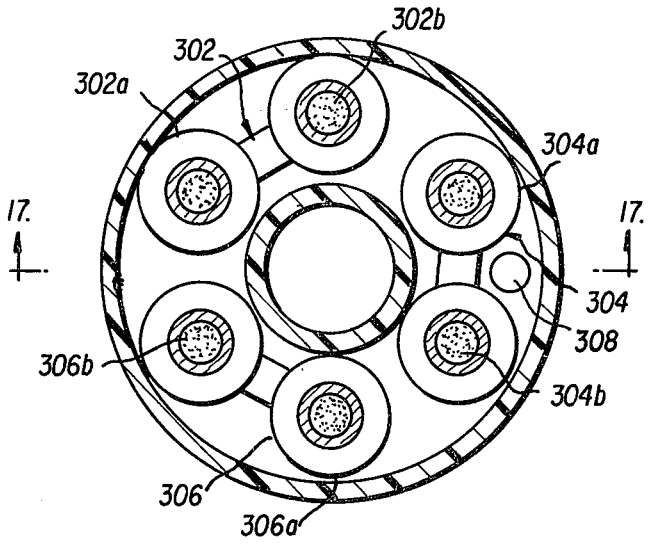
FIG. 16 is a plane view in cross-section of another ignition transformer according to the invention, the cross-section being taken through line 16—16 shown in FIG. 17.
Figure 17:
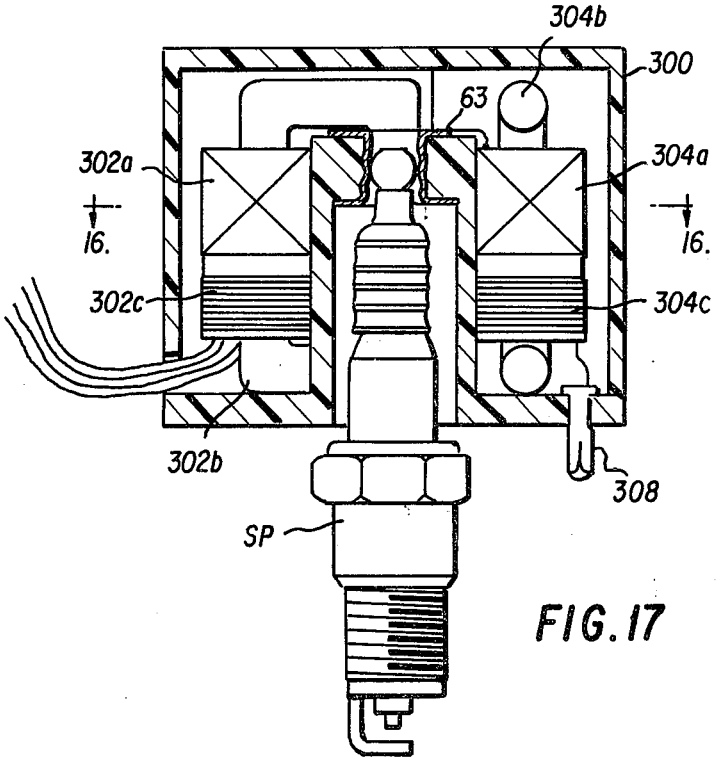
FIG. 17 is a cross-sectional side view taken along the line 17—17 shown in FIG. 16.

As shown in FIGS. 16 and 17, the ignition transformer of the invention can be made smaller and more reliable by disposing plural individual transformers in a planetary arrangement within a plastic or ceramic ignition transformer assembly housing 300. In the plan view shown in FIG. 16, three such individual transformers 302, 304 and 306 are shown. These transformers include respective high voltage secondary winding coils 302*a*, 304*a*, 306*a* wound around respective cores 302*b*, 304*b*, 306*b*. As shown in FIG. 18, also wound around each core is a low voltage primary winding coil 302*c*, 304*c*, 306*c*. It should be understood that each of the respective high voltage secondary winding coils of the individual transformers 302, 304, 306 are interconnected in series to provide a single one of the ignition transformers $T_7$–$T_{10}$. However, the low voltage primary winding coils of the individual transformers 302, 304, 306 can be wound either in series or in parallel or in some combination thereof in dependence upon the particular turns ratios selected as a matter of design choice, since relatively low voltages are involved. Preferably, the windings of each of the individual transformers 302, 304, 306 are $P_i$ wound, i.e. wound with layered windings, each layer having opposite pitch with respect to the adjacent layer. As shown in FIG. 17, a ground clip 308 is provided by which one side of the series connected high voltage secondary winding coils 302*a*, 302*b*, 302*c* can be grounded, it being understood that the other end of the series connected coils is connected to the terminal member 63 for making electrical connection to the spark plug SP.

The ignition transformer structure shown in FIGS. 16–18 is particularly advantageous because it enables the provision of smaller overall transformer structures mounted on the individual spark plugs. The embodiment shown in these drawings permits the utilization of smaller diameter cores which in turn results in the provision of smaller diameter coil windings, by which the stray capacitance inherent in the coil winding is reduced, resulting in faster rise time ignition pulses. Still further, by providing plural individual transformers, 302, 304, 306, there is less overlapping of windings in comparison with the implementation in which the equivalent number of turns is achieved on a single core with a single continuously wound winding, whereby the effective insulation between overlapped winding layers can be improved and the danger of short-circuits between layers of windings is reduced.

Although not shown in FIGS. 16 and 17 each of the plural transformers 302, 304, 306 can readily be provided with an additional centertapped control winding corresponding to winding 150 shown in FIG. 11 for use in the embodiment shown in FIGS. 9 and 10.

Obviously, numerous additional modifications and variations of the present invention are possible in light of the above teachings. It is therefore to be understood that within the scope of the appended claims, the invention may be practiced otherwise than is specifically described herein.

What is claimed as new and desired to be secured by Letters Patent of the United States is:

1. An ignition system for an internal combustion engine having plural cylinders comprising:

timing means coupled to a crankshaft of said engine for sequentially supplying plural timing control signals to a plurality of respective output terminals in synchronism with the rotation of said crankshaft, each of said output timing control signals being associated with a respective cylinder of said engine;

oscillator means for producing an AC output signal;

switch means coupled to said oscillator means for generating an AC drive signal based on said AC output signal, said switch means comprising a leakage transformer having a pair of output terminals across which said AC drive signal is provided;

a plurality of high voltage generator means, each of said generator means being associated with a respective cylinder of said engine, said generator means coupled to respective output terminals of said timing means to receive respective control signals therefrom, each generator means coupled to the output terminals of said leakage transformer and including means for producing a high voltage AC ignition signal when said drive AC signal and a respective timing control signal are simultaneously received; and a plurality of spark plugs each associated with a respective engine cylinder and each having a pair of electrodes to which a respective of said high voltage AC ignition signals is sequentially applied, whereby ignition arcing is produced across the electrodes of said spark plugs;

wherein after initiation of said arcing current developed across said electrode pair is limited by magnetic flux leakage within said leakage transformer whereby the level of said AC drive signal is correspondingly reduced.

2. An ignition system as recited in claim 1, wherein said timing means comprises:

a shutter coupled to rotate in synchronism with said crankshaft, said shutter including an opening therein;

a plurality of photo-interrupters positioned about said shutter, each photo-interrupters including a light source located adjacent to a first side of said shutter and a light sensor means located adjacent to said light source and adjacent to a second side of said shutter for producing an output signal when said opening in said shutter passes between said light source and said light sensor means; and amplifier means coupled to receive the output signal from each light sensor means in each photo-interrupter for supplying said timing control signals to respective of said output terminals of said timing means each time an output signal is received from a respective of said photo-interrupters.

3. An ignition system as recited in claim 1, wherein each of said high voltage generator means comprises:

an ignition transformer including a high permeability toroidal core, and control, primary and secondary windings wound on said core, said control winding coupled to a respective output terminal of said timing means and receiving a respective timing control signal therefrom, said primary winding coupled to said leakage transformer and driven by said AC drive signal, and said secondary winding coupled to a respective spark plug means.

4. An ignition system according to claim 3, wherein said timing means comprises:

means for sequentially short-circuiting the control windings coupled to respective output terminals of said sensor means in accordance with the angular position of said crankshaft.

5. An ignition system according to claim 4, further comprising:

said control winding of each ignition transformer including a centertap connected to a first predetermined voltage, and opposed winding end terminals;

said timing means comprising means for coupling said opposed winding end terminals of each control winding to said first predetermined voltage in synchronism with the rotation of said crankshaft in the absence of a respective timing control signal when no ignition of said spark plug means is to be generated, and for open circuiting said opposed winding end terminals in the presence of a respective timing control signal when ignition of said spark plug means is to be generated.

6. An ignition system according to claims 1, 2, 3, 4 or 5, wherein said leakage transformer comprises:

a main core;

primary and secondary windings wound on said main core, said primary winding coupled to said oscillator means, said secondary winding coupled to said plurality of high voltage generator means;

a leakage core coupled to said main core through a non-magnetic spacer.

7. An ignition system according to claim 6, further comprising:

an auxiliary winding wound on said leakage core; and means for selectively short-circuiting said auxiliary winding thereby to reduce flux leakage in said leakage core and increase the level of said high voltage AC ignition signal produced by said high voltage generator means.

8. An ignition system according to claim 3, wherein each ignition transformer comprises:

a housing defining an axis concentric with a respective spark plug, plural core members disposed in a planetary arrangement around the housing axis, each core member having wound thereon at least one primary winding and at least one secondary windings, wherein the secondary winding wound on each of said core members of a respective ignition transformer are connected in series.

9. An ignition system according to claim 8, wherein the primary windings wound on the core members of a respective ignition transformer are connected in series.

10. An ignition system according to claim 8, wherein the primary windings wound on the core members of a respective ignition transformer are connected in parallel.

11. An ignition system according to claim 8, wherein the primary windings wound on the core members of a respective ignition transformer are connected in a series and parallel circuit.

12. An ignition system for an internal combustion engine having plural cylinders comprising:

timing means coupled to a crankshaft of said engine for sequentialy supplying plural timing control signals to a plurality of respective output terminals in synchronism with the rotation of said crankshaft, each of said output timing control signals being associated with a respective cylinder of said engine;

oscillator means for producing an AC output signal;

switch means coupled to said oscillator means for generating at a pair of output terminals an AC drive signal based on said AC output signal;

a plurality of high voltage generator means, each of said generator means being associated with a respective cylinder of said engine, said generator means coupled to respective output terminals of said timing means to receive respective control signals therefrom, each generator means coupled to the output terminals of said switch means and including means for producing a high voltage AC ignition signal when said drive AC signal and a respective timing control signal are simultaneously received;

a plurality of spark plugs each associated with a respective engine cylinder and each having a pair of electrodes to which a respective of said high voltage AC ignition signals is sequentially applied, whereby ignition arcing and ignition current is produced across the electrodes of said spark plugs; and said switch means comprising means for limiting the voltage level of each AC drive signal applied to a respective high voltage generator means based on the level of said ignition current across the electrodes of said spark plugs.

13. An ignition system according to claim 12, wherein said voltage level limiting means comprises:

a leakage transformer.

14. A combination ignition transformer and spark plug cover assembly comprising:

a housing adapted to be mounted on a spark plug, said housing defining an axis generally concentric with said spark plug;

plural transformers mounted in a planetary arrangement around said axis, each transformer comprising a high permeability core, and at least one primary winding and at least one secondary winding wound on said core; and said secondary windings of each of said plural transformers connected in series and adapted to be electrically coupled to the spark plug.

15. An assembly according to claim 14, wherein each transformer comprises plural secondary windings, each of which are connected in series with each other and the secondary windings of each of said plural transformers.

16. An assembly according to claim 14, wherein the primary windings of said transformers are connected in series.

17. An assembly according to claim 14, wherein the primary windings of said transformers are connected in parallel.

18. An assembly according to claim 14, wherein the primary windings of said transformers are connected in series and parallel.

* * * * *

UNITED STATES PATENT AND TRADEMARK OFFICE

CERTIFICATE OF CORRECTION

PATENT NO. : 4,446,842

DATED : MAY 8, 1984

INVENTOR(S) : SHINICHIRO IWASAKI

It is certified that error appears in the above-identified patent and that said Letters Patent is hereby corrected as shown below:

Column 1, line 60, change "distributer" to --distributor--.

Column 2, line 39, change "distributer" to --distributor--.

Column 3, line 64, change "would" to --wound--.

Column 4, line 39, change "4a through 4" to --4a through 4d--.

Column 6, line 3, change "z" to --Z--.

Column 11, line 39, change "plus" to --plug--.

Column 12, line 53, change "conceiveably" to --conceivably--.

Column 12, line 54, change "become" to --becoming--.

Column 13, line 4, delete "is".

Column 14, line 27, delete "ti".

Column 16, line 11, change "interrupters" to --interrupter--.

UNITED STATES PATENT AND TRADEMARK OFFICE

CERTIFICATE OF CORRECTION

PATENT NO. : 4,446,842

DATED : May 8, 1984

INVENTOR(S) : Shinichiro Iwasaki

It is certified that error appears in the above-identified patent and that said Letters Patent is hereby corrected as shown below:

Column 17, line 14, "windings" should read -- winding --.

Signed and Sealed this

*Twentieth* Day of *November 1984*

[SEAL]

*Attest:*

GERALD J. MOSSINGHOFF

*Attesting Officer*

*Commissioner of Patents and Trademarks*